US010087571B2

(12) United States Patent
Kulkarni

(10) Patent No.: US 10,087,571 B2
(45) Date of Patent: Oct. 2, 2018

(54) DRYER APPLIANCES AND METHODS FOR OPERATING DRYER APPLIANCES UTILIZING WIRELESS MOISTURE DATA TRANSFER SYSTEMS

(71) Applicant: General Electric Company, Schenectady, NY (US)

(72) Inventor: Ashutosh Kulkarni, Bangalore (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 335 days.

(21) Appl. No.: 14/820,771

(22) Filed: Aug. 7, 2015

(65) Prior Publication Data

US 2017/0037563 A1 Feb. 9, 2017

(51) Int. Cl.

| | |
|---|---|
| ***F26B 3/00*** | (2006.01) |
| ***D06F 58/28*** | (2006.01) |
| ***D06F 58/04*** | (2006.01) |

(52) U.S. Cl.

CPC ..... *D06F 58/28* (2013.01); *D06F 58/04* (2013.01); *D06F 2058/2816* (2013.01); *D06F 2058/2829* (2013.01); *D06F 2058/2838* (2013.01)

(58) Field of Classification Search

CPC ..... D06F 58/00; D06F 58/28; D06F 58/04; D06F 2058/2877; D06F 2058/2816; D06F 2058/2838; D06F 2058/2829; D06F 2058/2041; D06F 2058/2854; D06F 2058/2861

USPC ..... 34/499

See application file for complete search history.

(56) References Cited

U.S. PATENT DOCUMENTS

| | | | | |
|---|---|---|---|---|
| 3,203,107 | A | 8/1965 | Scofield | |
| 7,024,795 | B2 | 4/2006 | Tadano et al. | |
| 7,055,262 | B2 | 6/2006 | Goldberg et al. | |
| 7,475,495 | B2 | 1/2009 | Chiles et al. | |
| 2006/0242858 | A1* | 11/2006 | Beaulac | D06F 58/28 34/446 |
| 2011/0203131 | A1 | 8/2011 | Armstrong | |
| 2012/0005918 | A1* | 1/2012 | Kim | D06F 58/28 34/491 |

(Continued)

FOREIGN PATENT DOCUMENTS

| | | |
|---|---|---|
| EP | 1148169 | 10/2001 |
| EP | 1321563 | 6/2003 |
| EP | 1997951 | 3/2011 |

(Continued)

*Primary Examiner* — Kenneth Rinehart
*Assistant Examiner* — Bao D Nguyen
(74) *Attorney, Agent, or Firm* — Dority & Manning, P.A.

(57) ABSTRACT

Dryer appliances and methods are provided. A method includes receiving during rotation of a drum of the dryer appliance a voltage signal which corresponds to a moisture level within a chamber of the drum, and determining whether the voltage signal corresponds to a predetermined drying profile of a plurality of predetermined drying profiles. The method further includes applying a drying sequence which corresponds to one of the plurality of predetermined drying profiles when the voltage signal corresponds to the one of the plurality of predetermined drying profiles. The method further includes determining whether the voltage signal corresponds to a wet patch indicator, and reversing a direction of rotation of the drum when the voltage signal corresponds to the wet patch indicator.

16 Claims, 10 Drawing Sheets

(56) References Cited

U.S. PATENT DOCUMENTS

2016/0201253 A1* 7/2016 Kulkarni ..... D06F 58/28
307/104

FOREIGN PATENT DOCUMENTS

| | | |
|---|---|---|
| EP | 2527517 | 11/2012 |
| GB | 1066760 | 4/1967 |
| KR | 2007-0081371 | 8/2007 |
| WO | WO2004/022836 | 3/2004 |
| WO | WO2012/150726 | 11/2012 |
| WO | WO2013/182402 | 12/2013 |

* cited by examiner

DRYER APPLIANCES AND METHODS FOR OPERATING DRYER APPLIANCES UTILIZING WIRELESS MOISTURE DATA TRANSFER SYSTEMS

FIELD OF THE INVENTION

The present disclosure relates generally to dryer appliances. More particularly, the present disclosure is directed to energy-efficient methods for operating dryer appliances which utilize wireless moisture data transfer systems.

BACKGROUND OF THE INVENTION

In order to provide enhanced control of a dryer appliance, it can be desirable to know the moisture content of articles, such as clothes being dried the dryer. For example, the dryer can be operated until it is sensed that the moisture content of the clothing has fallen below a desired amount. The heater or other appropriate components of the dryer appliance can then be deactivated or otherwise controlled accordingly.

Certain existing dryer appliances use two metal rods in parallel or a combination of rods and the drum surface as a sensor to detect available moisture in the clothing. Other sensors for detecting temperature and relative humidity can be added as well to sense internal air properties. These sensors typically receive excitation power from the dryer control board via a physical connection such as electrical wires. Therefore, the sensors are placed on non-rotating components of the dryer, such as the door or a fixed back wall. However, for many of such sensors, physical contact between the sensor and the clothes being dried is required for accurate sensor readings. Therefore, sensors positioned on the non-rotating components of the dryer, such as the door or a fixed back wall can have less frequency of contact with the entire clothing and do not provide consistently accurate readings.

Placement of the sensors on the rotating components of the dryer, such as the drum or associated lifters or baffles, can result in obtaining more accurate readings at a higher frequency. However, placement of the sensors on the rotating components can present additional problems. For example, wireless communication systems may be required for transmitting the data from rotating components to the non-rotating components.

In addition, one or more local power sources, such as batteries, may be required to power the sensors and the rotating components, including the rotating data transfer components. As such components generally must be powered over the lifespan of a dryer appliance, energy efficiency is a key requirement for extending battery life over the entire lifespan.

Accordingly, improved dryer appliances and methods for operating dryer appliances are desired. In particular, energy-efficient wireless moisture data transfer systems and methods of operation would be advantageous.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a method for operating a dryer appliance is provided. The method includes receiving during rotation of a drum of the dryer appliance a voltage signal which corresponds to a moisture level within a chamber of the drum, and determining whether the voltage signal corresponds to a predetermined drying profile of a plurality of predetermined drying profiles. The method further includes applying a drying sequence which corresponds to one of the plurality of predetermined drying profiles when the voltage signal corresponds to the one of the plurality of predetermined drying profiles. The method further includes determining whether the voltage signal corresponds to a wet patch indicator, and reversing a direction of rotation of the drum when the voltage signal corresponds to the wet patch indicator.

In accordance with another embodiment of the present disclosure, a dryer appliance is provided. The dryer appliance includes a cabinet, and a drum rotatably mounted within the cabinet, the drum defining a chamber configured for the receipt of articles for drying. The dryer appliance further includes one or more sensors positioned within the chamber, wherein the one or more sensors output one or more voltage signals which correspond to moisture levels within the chamber. The dryer appliance further includes a near field communication tag positioned on an exterior surface of the drum and in communication with the one or more sensors to receive the voltage signals from the one or more sensors. The dryer appliance further includes a near field communication reader positioned exterior to the drum and configured to receive the voltage signals from the near field communication tag through near field communication. The dryer appliance further includes a main controller in operable communication with the near field communication reader. The main controller is configured for receiving during rotation of the drum of the dryer appliance a voltage signal which corresponds to a moisture level within the chamber of the drum, and determining whether the voltage signal corresponds to a predetermined drying profile of a plurality of predetermined drying profiles. The main controller is further configured for applying a drying sequence which corresponds to one of the plurality of predetermined drying profiles when the voltage signal corresponds to the one of the plurality of predetermined drying profiles. The main controller is further configured for determining whether the voltage signal corresponds to a wet patch indicator, and reversing a direction of rotation of the drum when the voltage signal corresponds to the wet patch indicator.

These and other features, aspects and advantages of the present invention will be better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
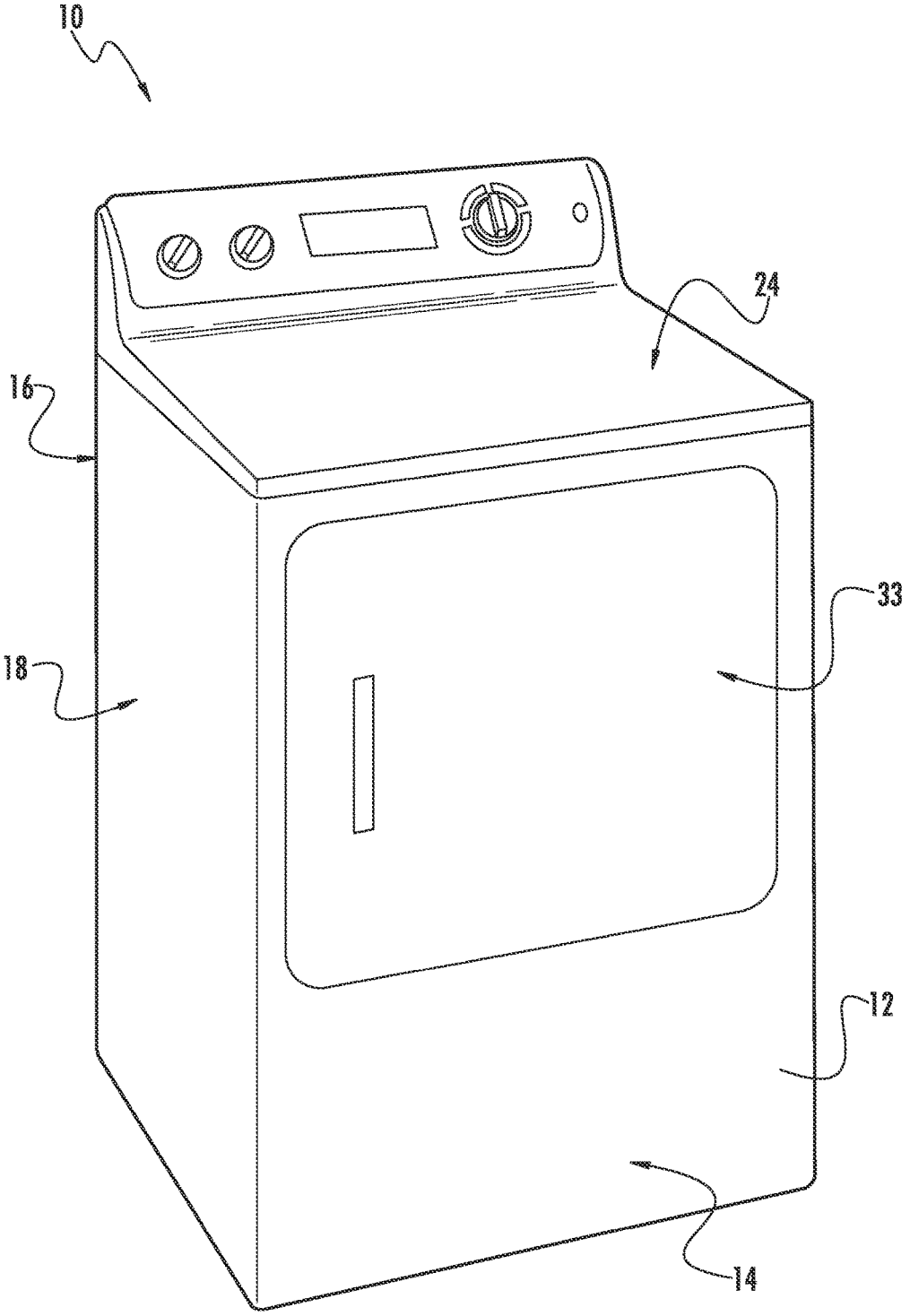
FIG. 1 provides a perspective view of a dryer appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to wireless data transfer systems for use in a dryer appliance and energy-efficient methods of operating the same. In one example embodiment, conductive moisture sensors such as rods are positioned on each baffle on the inside of a rotating drum of a dryer appliance. A near field communication (NFC) tag is placed on the outside surface of the drum. The tag receives voltage signals via a wired connection to the sensors. The tag converts the analog voltage signals to digital data and then stores the digital data in a memory (e.g. EEPROM) of an integrated circuit. An NFC reader is installed at a stationary position on the dryer and can obtain the stored voltage signals from the tag whenever the tag rotates past the reader. The reader then provides the data to a main controller of the dryer appliance, whereby the main controller can control the dryer appliance based on the moisture values of clothes contained within the drum.

Figure 2:
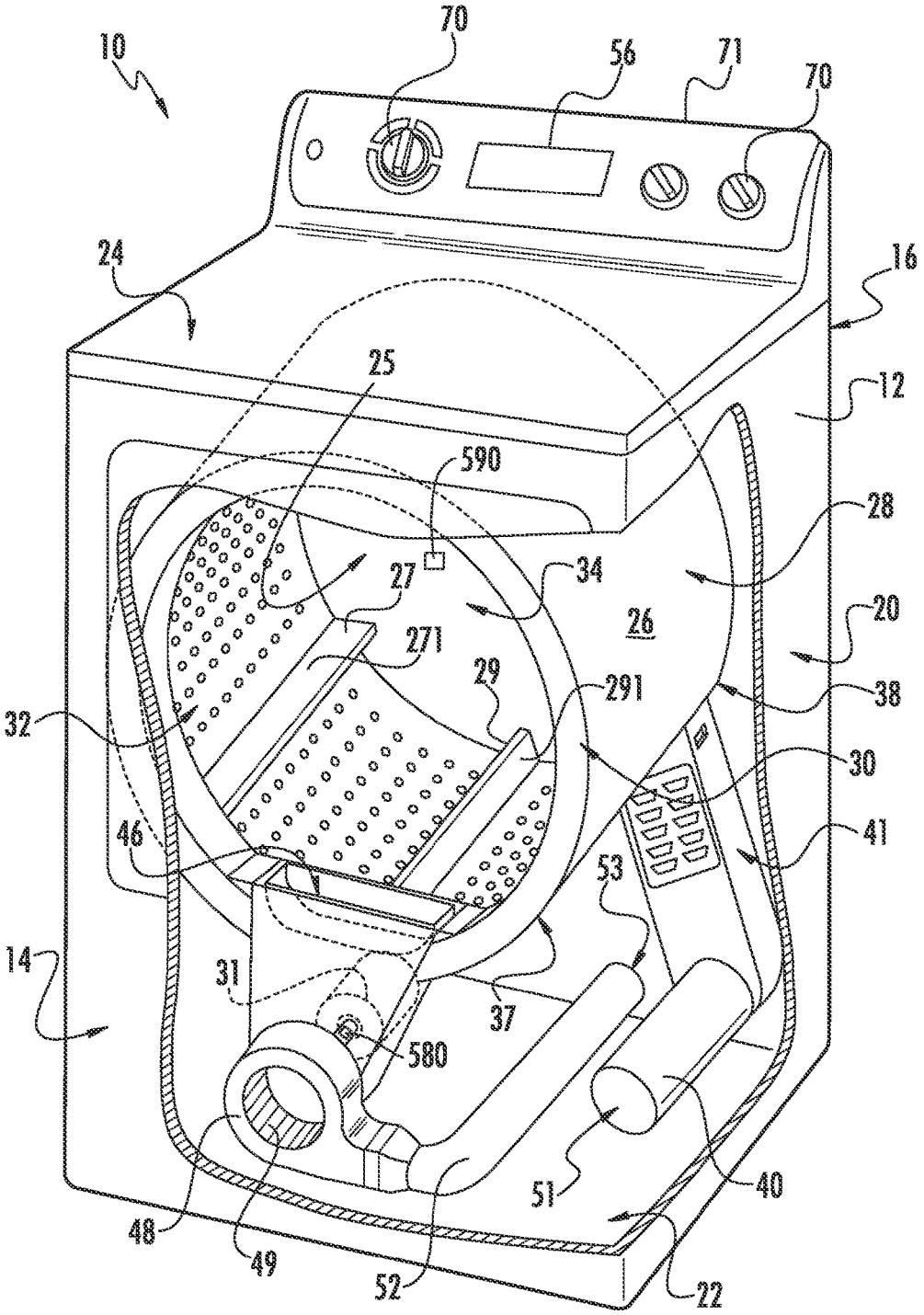
FIG. 2 provides another perspective view of the dryer appliance of FIG. 1 with a portion of a cabinet of the dryer appliance removed in order to show certain components of the dryer appliance.

FIG. 1 illustrates a dryer appliance 10 according to one embodiment of the present disclosure. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 defines a chamber 25 for receipt of articles for drying. Drum 26 extends between a front portion 37 and a back portion 38.

As used herein, the term "articles" includes but need not be limited to clothing, fabrics, textiles, garments, linens, papers, or other items from which the extraction of moisture is desirable. Furthermore, the term "load" or "laundry load" refers to the combination of articles that may be washed together in a washing machine or dried together in a laundry dryer (e.g. dryer appliance) and may include a mixture of different or similar articles of different or similar types and kinds of clothing, fabrics, textiles, garments and linens within a particular laundering process.

A motor 31 is configured for rotating drum 26 about the horizontal axis, e.g., via a pulley and a belt (not shown). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles (e.g. lifters 27 and 29) are provided within chamber 25 of drum 26 to lift articles therein and then allow such articles to tumble back to a bottom of drum 26 as drum 26 rotates.

In some embodiments, each lifter can have a lifting face and a non-lifting face. For example, in the instance in which the drum 26 rotates clockwise from the perspective of a viewer situated in front of the opening 32, lifter 27 will have a lifting face 271. Likewise, in the instance in which the drum 26 rotates clockwise from the perspective of a viewer situated in front of the opening 32, lifter 29 will have a non-lifting face 291. As will be discussed further below, in some embodiments of the present disclosure, one or more sensors may be positioned on the lifting face and/or non-lifting face of each lifter. Furthermore, lifters having shapes other than those shown in FIG. 2 may be used as well.

In some embodiments, as discussed herein, the drum may reverse rotational directions during portions of various drying operations. In such embodiments, for example, the face of each lifter that performs lifting functionality for a majority of the operation time can be designated as the lifting face. As another example, the face of each lifter that performs lifting functionality during a critical period in which sensing of load moisture content is most relevant and scrutinized (e.g. the final period of drying) can be designated as the lifting face.

Drum 26 also includes a back or rear wall 34, e.g., at back portion 38 of drum 26. Rear wall 34 can be fixed or can be rotatable. A supply duct 41 is mounted to rear wall 34 and receives heated air that has been heated by a heating assembly or system 40.

Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., in order to dry damp articles disposed within chamber 25 of drum 26. For example, heating assembly 40 can include a heating element (not shown), such as a gas burner or an electrical resistance heating element, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air can accumulate moisture, e.g., from damp clothing disposed within chamber 25. In turn, air handler 48 draws moisture saturated air through a screen filter (not shown) which traps lint particles. Such moisture statured air then enters an exit duct 46 and is passed through air handler 48 to an exhaust duct 52. From exhaust duct 52, such moisture statured air passes out of dryer appliance 10 through a vent 53 defined by cabinet 12. After the clothing articles have been dried, they are removed from the drum 26 via opening 32. A door 33 provides for closing or accessing drum 26 through opening 32.

A cycle selector knob 70 is mounted on a cabinet backsplash 71 and is in communication with a main processing device or main controller 56. Signals generated in controller 56 operate motor 31 and heating assembly 40 in response to the position of selector knobs 70. Alternatively, a touch screen type interface may be provided. As used herein, "processing device" or "controller" may refer to one or more microprocessors, microcontroller, ASICS, or semiconductor devices and is not restricted necessarily to a single element. The controller can be programmed to operate drying machine 10 by executing instructions stored in memory. The controller may include, or be associated with, one or more memory elements such as for example, RAM, ROM, or electrically erasable, programmable read only memory (EEPROM).

Figure 3:
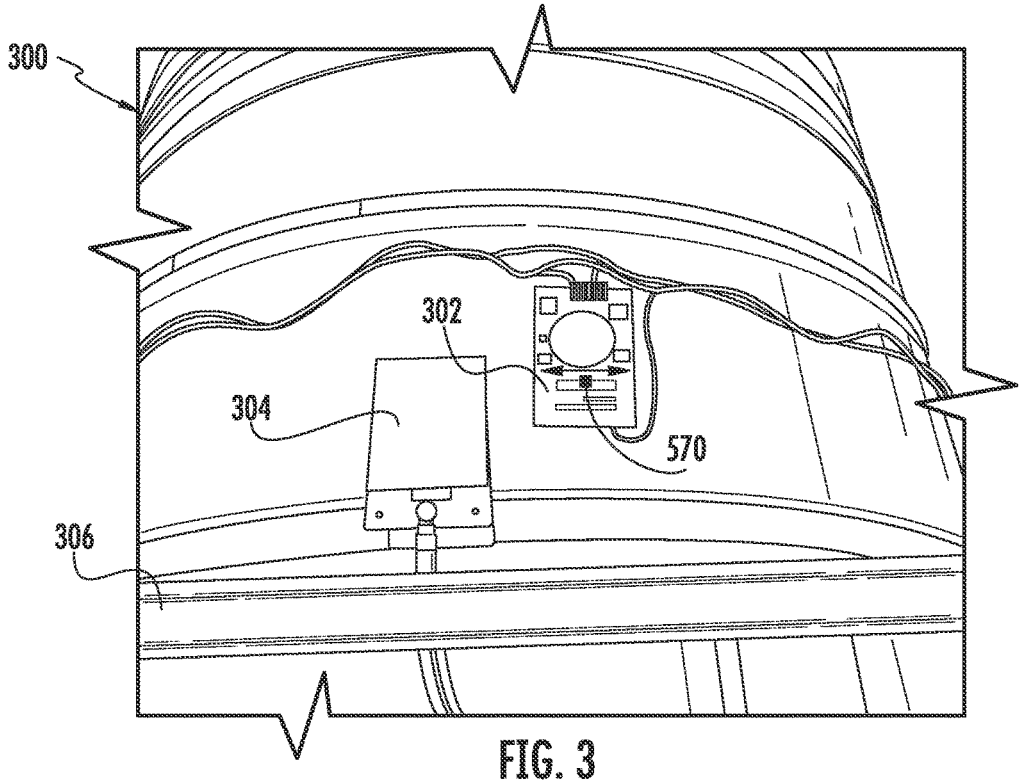
FIG. 3 depicts an exterior of a drum of a dryer appliance in accordance with one embodiment of the present disclosure.

FIG. 3 depicts an exterior 300 of a drum of an example dryer appliance according to an example embodiment of the present disclosure. Also shown in FIG. 3 is a near field communication (NFC) tag 302 mounted to an exterior surface of the drum. Sensor wiring and battery are shown connected to the tag 302. An NFC reader 304 is mounted to a stationary member 306 of the dryer appliance, such as to the cabinet 12. According to an aspect of the present disclosure, the NFC tag 302 can receive voltage signals from one or more sensors positioned within the interior of the drum. The voltage signals can be wirelessly communicated from the tag 302 to the reader 304. The reader 304 can then provide the voltage signals to a main controller of the dryer appliance. The voltage signals can be correlated to moisture content levels by the main controller, and operation of the dryer appliance can be controlled based on an amount of moisture contained within clothes present in the drum.

Figure 4:
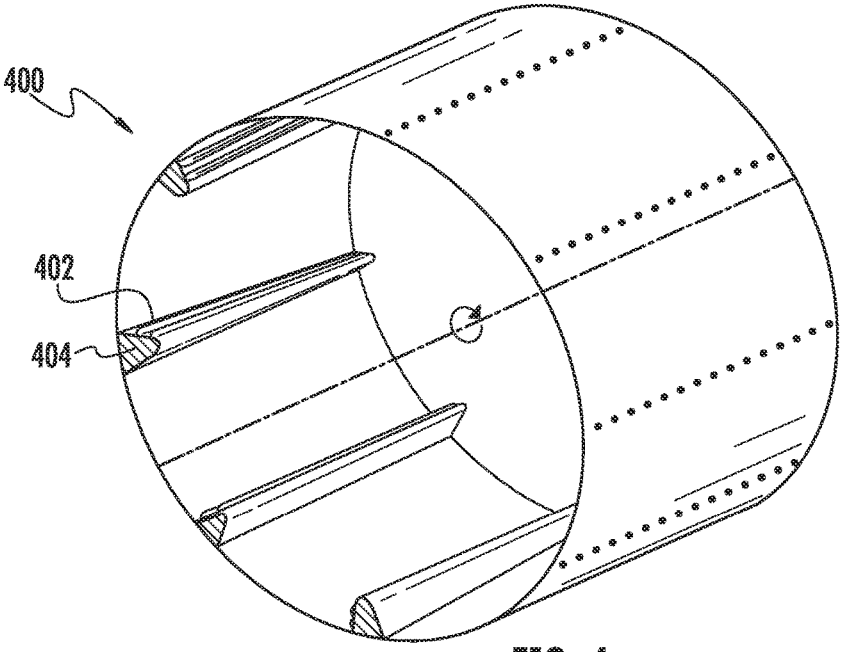
FIG. 4 depicts an interior of a drum of dryer appliance in accordance with one embodiment of the present disclosure.

FIG. 4 provides a simplified depiction 400 of a first example sensor placement according to an example embodiment of the present disclosure. In particular, the first example sensor placement includes one of a plurality of sensors placed on the lifting face of each of a plurality of lifters included in a drum of a dryer appliance. As an example, sensor 402 (e.g. a pair of conductive rods) is positioned on a lifting face of lifter 404.

Other sensor placements be used as well. As an example, in other embodiments, a plurality of sensors are placed on the non-lifting faces of the plurality of lifters instead of the lifting faces. As another example, the plurality of sensors can be placed on both the lifting faces and the non-lifting faces. As yet another example, the plurality of sensors can be placed within each of a plurality of basins formed between respective adjacent pairs of lifters. As another example, the plurality of sensors can be circumferentially-oriented sensors positioned along an interior surface of the drum at respective longitudinal axis positions. As yet another example, a conductive (e.g. metallic) coating or cladding covering two different portions of the surface of each lifter can serve as the plurality of sensors. In general, such sensors in accordance with the present disclosure are provided within the chamber 25 of drum 26.

Figure 5:
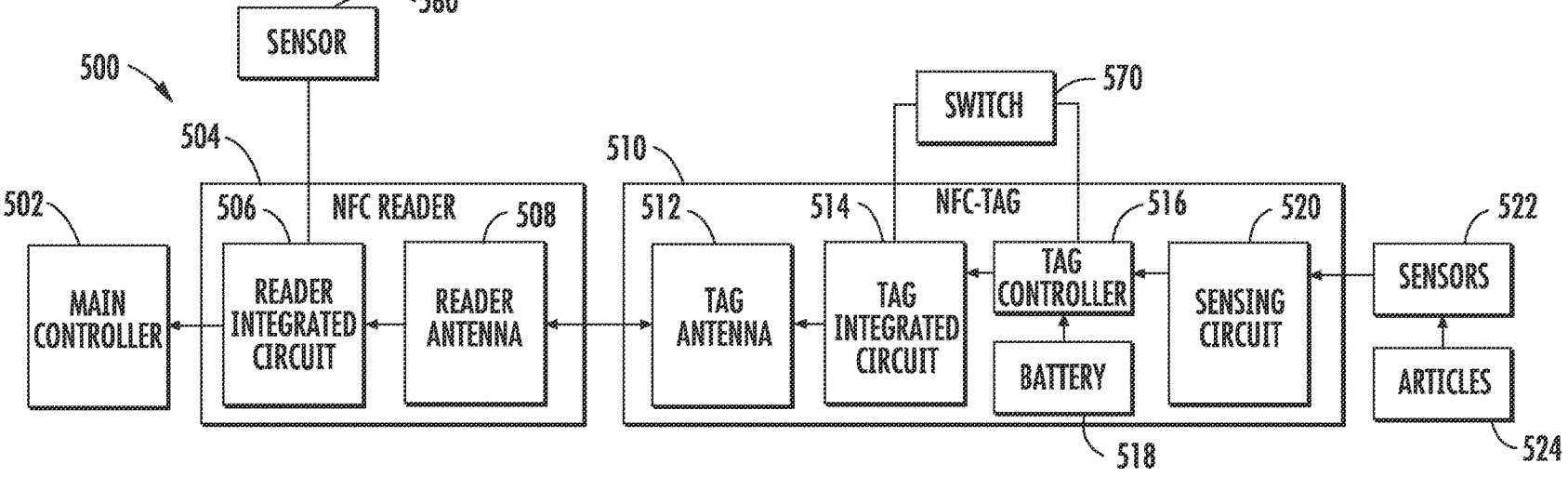
FIG. 5 is a schematic diagram of an dryer appliance wireless moisture data transfer system in accordance with one embodiment of the present disclosure.

FIG. 5 depicts a block-diagram of an example dryer appliance wireless moisture data transfer system 500 according to an example embodiment of the present disclosure. In particular, FIG. 5 depicts one example configuration for the flow of data in system 500. System 500 can include a main controller 502, an NFC reader 504, an NFC tag 510, and one or more sensors 522.

The sensors 522 are conductivity sensors which generally provide output voltage signals. As an example, each sensor 522 can have two conductive (e.g. metallic) rods in parallel, two conductive strips in parallel, or two different metal coatings on a lifter surface. Each sensor (e.g. each pair of conductive rods, etc.) can provide an output signal (e.g. voltage signal) corresponding to conductivity and/or resistance of articles being dried. This voltage level generally corresponds to the moisture content of the articles that are contacting the sensors 522, with increases in voltage levels corresponding with decreases in moisture content and decreases in voltage levels corresponding with increases in moisture content.

The voltage level of a sensor 522 decreases compared to a reference voltage when articles with moisture simultaneously contacts any or all of the sensor pairs. Furthermore, the amount by which the voltage decreases when articles with moisture simultaneously contacts the two conductive portions can be proportional to the amount of moisture contained within the articles. Therefore, in some embodiments, one of the conductive portions of the sensor may be held at a predetermined voltage (e.g. five volts). The voltage at such conductive portion will experience a decrease when clothing with moisture contacts both conductive portions. Such decrease will be proportional to the amount of moisture and will be reflected in the output voltage signal.

In some embodiments, all of the sensors 522 can be wired together to provide a single, combined output voltage signal. Thus, the combined output voltage signal will reflect moisture content for the entirety of the drum. The combined output signal can be provided to the NFC tag 510. In further embodiments, sensors 522 may be organized into two or more groupings (e.g. based on sensor type or sensor position) that respectively provide two or more combined output voltage signals to the NFC tag 510.

The NFC tag 510 can include circuitry or other components for receiving the output voltage signal from the sensors 522, converting the output signal from analog to digital, and then storing the data in a local memory (e.g. an EEPROM). In particular, NFC tag 510 can include a sensing circuit 520, a tag controller 516, a battery 518, a tag integrated circuit (IC) 514, and a tag antenna 512.

NFC tag 510 can be mounted on an exterior surface of the dryer appliance drum. Battery 518 can provide excitation energy to both sensors 522 and some or all of the other components of NFC tag 510. Battery 518 can be any suitable battery for providing energy. In some embodiments, the battery 518 can be a small, coin-type battery. Battery 518 can be physically included within the NFC tag 510 or can be mounted separately on the drum surface or inside the lifters.

NFC reader 504 can include components and associated circuitry for obtaining data stored at NFC tag 510 and then providing the obtained data to the main controller 502. In particular, NFC reader 504 can include a reader antenna 508 and a reader integrated circuit (IC) 506.

NFC reader 504 can be secured to the cabinet of the dryer appliance so that it is stationary. NFC reader 504 can be positioned adjacent to a rotational path of the NFC tag 510. Therefore, in some embodiments, data transfer between NFC tag 510 and NFC reader 504 can occur once per drum rotation when the tag 510 is located adjacent to the reader 504.

As an example implementation of the system 500, the sensing/control process can begin with the sensors 522 measuring moisture values of articles 524 present in the drum of the dryer appliance. For example, the sensors 522 can output an analog signal describing a voltage between conductive portions of the sensors.

Next, the NFC tag 510 can receive the voltage signals, in the form of analog data from the sensors 522 via the sensing circuit 520. The tag controller 516 can convert the analog data into digital data and can store the digital data in a memory included in the tag IC 514 (e.g. an EEPROM included within the tag IC 514).

When the drum is positioned such that the NFC tag 510 and NFC reader 504 are located adjacent to one another, the NFC reader 504 can obtain, such as via antenna 508, the digital data from the NFC tag 510 using near field communication. The NFC reader 504 can store the digital data, such as in reader IC 506, and provide the voltage signals to the main controller 502. Main controller 502 can control the dryer appliance based on the data received from the NFC reader 504, as discussed herein Thus, generally, the dryer appliance can be stopped upon sensing that the moisture level is satisfactory, thereby preventing over-drying or under-drying conditions. By avoiding over-drying, wear and tear on the clothing can be reduced, energy consumption can be improved, and service calls due to overheating of clothing can be avoided.

Furthermore, although system 500 is shown as using near field communication to wirelessly transfer voltage signals, in some embodiments of the present disclosure, other wireless communications protocols or methods can be used in addition or alternatively to NFC. For example, any other wireless communication technologies such as Bluetooth, Wi-Fi, ZigBee, RFID, infrared, optical, or other wireless communication methods can be applied for the wireless transmission of moisture data between the tag and the reader.

Figure 6:
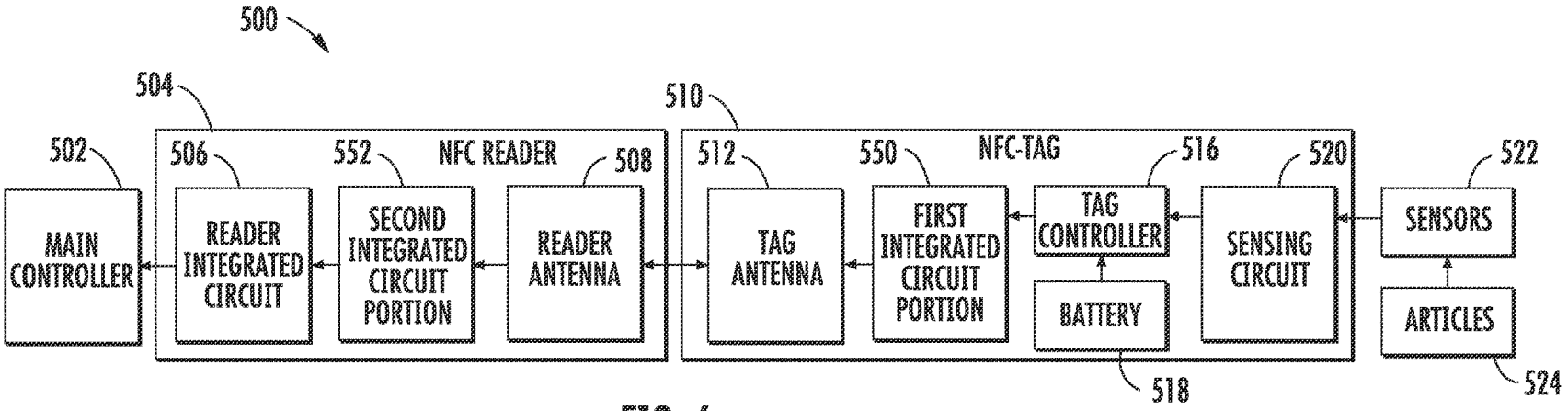
FIG. 6 is a schematic diagram of an dryer appliance wireless moisture data transfer system in accordance with another embodiment of the present disclosure.

FIG. 6 illustrates another embodiment of system 500. In this embodiment, the IC 514 which converts the voltage signals from analog data to digital data includes a first portion 550 and a second portion 552. Each portion includes a portion of the circuitry of IC 514. The first portion 550 is provided in the NFC tag 510, and the second portion 552 is provided in the NFC reader 504. Accordingly, final steps of the conversion of the analog data to digital data may occur in the NFC reader 504, rather than in the NFC tag 510, advantageously conserving battery 518 life.

Figure 7:
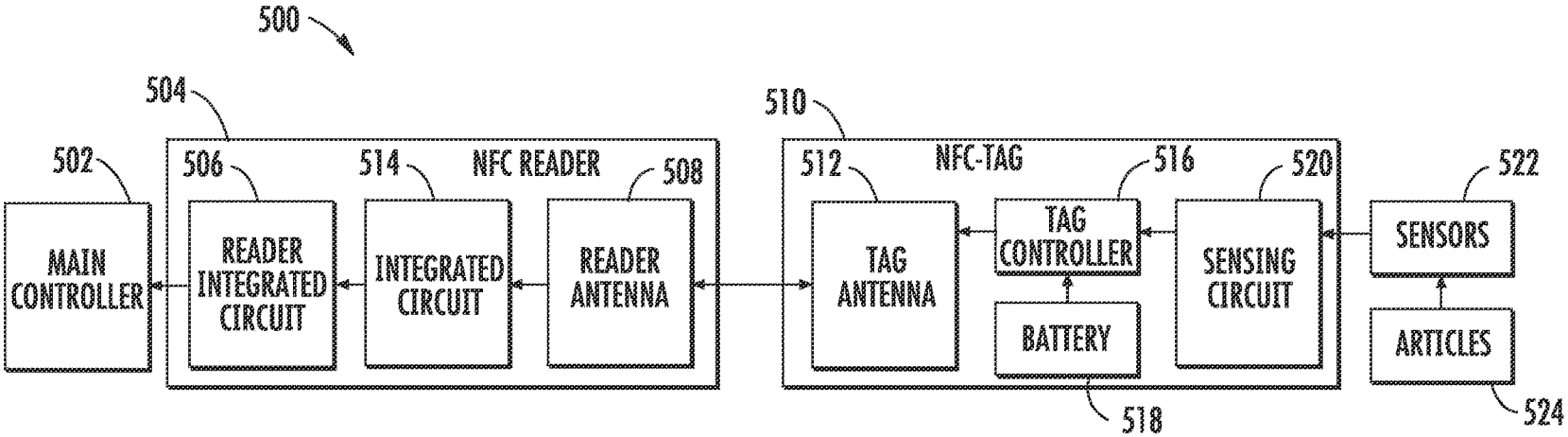
FIG. 7 is a schematic diagram of an dryer appliance wireless moisture data transfer system in accordance with another embodiment of the present disclosure.
Figure 8:
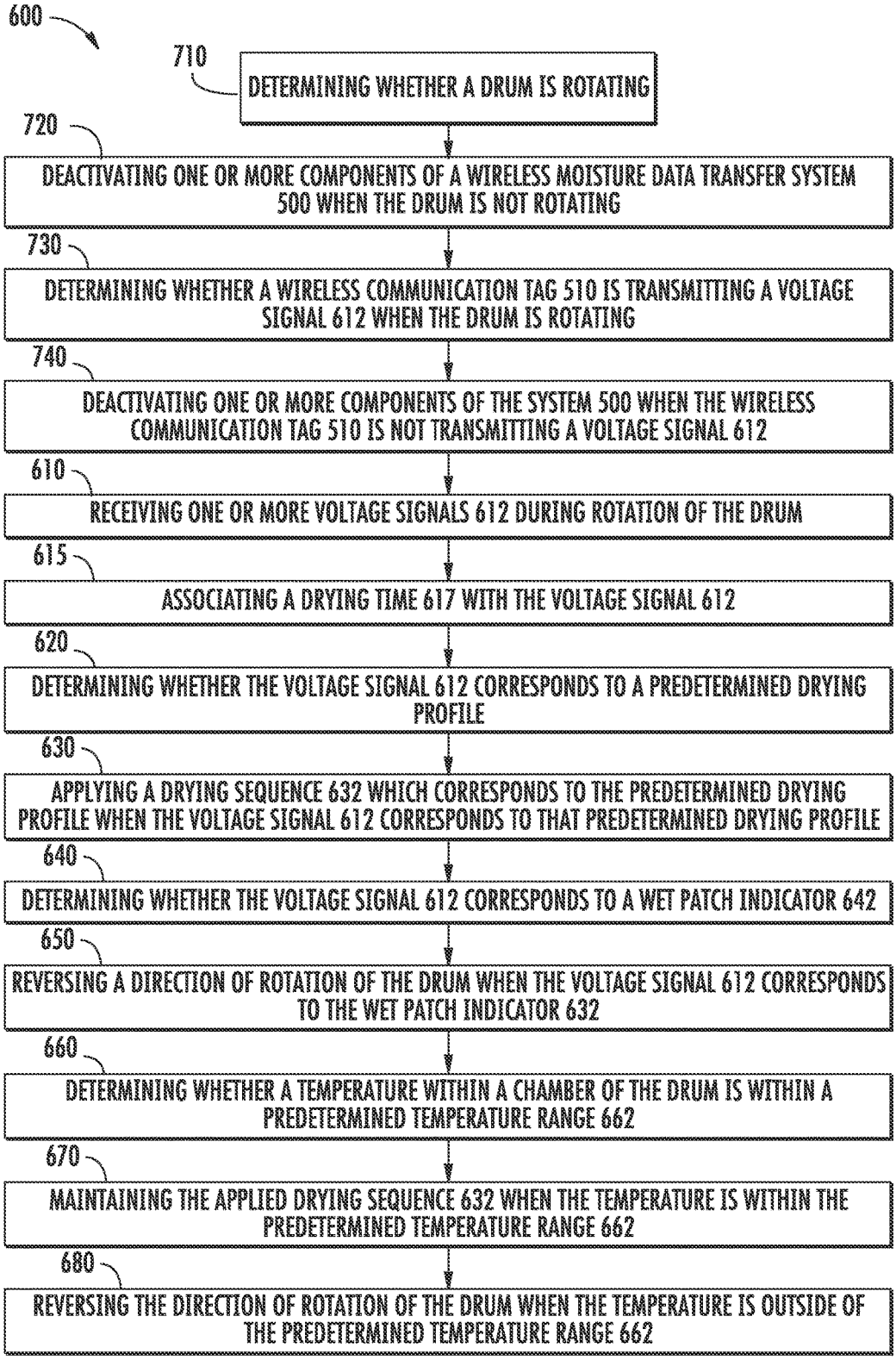
FIG. 8 is a flow chart of a method for operating a dryer appliance in accordance with one embodiment of the present disclosure.

FIG. 7 illustrates another embodiment of system 500. In this embodiment, the IC 514 which converts the voltage signals from analog data to digital data is entirely provided in the NFC reader 504. Accordingly, the conversion of the analog data to digital data may occur in the NFC reader 504, rather than in the NFC tag 510, advantageously conserving battery 518 life.

Referring again to FIG. 5, as well as to FIG. 3, in some embodiments, system 500 may additionally include a switch 570 which is activated by centrifugal force. For example, when the drum is not rotating and thus stationary, the switch 570 may default to an "off" position wherein components coupled to the switch 570 are deactivated. When the drum is rotating, centrifugal force may bias the switch 570 to an "on" position wherein components coupled to the switch 570 are activated. Switch 570 may for example be coupled (for example via a physical connection such as electrical wires) to the IC 514 and/or controller 516, and may thus deactivate these components when the drum is not rotating, advantageously conserving battery 518 life.

Referring still to FIG. 5 as well as to FIG. 2, in some embodiments a sensor 580, such as a speed sensor, accelerometer, voltage sensor, current sensor, etc., may be provided for monitoring motor 31 operation. The sensor 580 may generally sense operation of the motor 31, such as by sensing voltage levels, current levels, movement of a shaft or other component of the motor 31, etc. Accordingly, sensor 580 may detect whether the motor 31 is active, and thus may provide information as to whether the drum is rotating. For example, when the motor 31 is active, the drum is rotating, and when the motor 31 is not active, the drum is not rotating. This sensor 580 may further be coupled to, for example, one or more components of the NFC reader 504, such as the IC 506, or may be coupled to the main controller 502. The sensor 580 may, either directly or through controller 502, deactivate the NFC reader 504 when the drum is not rotating and activate the NFC reader 504 when the drum is rotating, advantageously conserving battery 518 life.

Additionally it should be noted that one or more temperature sensors 590, such as thermistors, may be provided in the chamber 25 for measuring air temperatures within the chamber 25.

Referring now to FIGS. 8 through 11, the present disclosure is further directed to methods 600 for operating dryer appliances 10, and in particular dryer appliances 10 which utilize systems 500. In exemplary embodiments, the various methods steps discussed herein may, for example, be performed by a main controller of the dryer appliance 10. The main controller may thus be configured to perform such steps.

A method 600 may, for example, include the step 610 of receiving one or more voltage signals 612, each of which corresponds to a moisture level within the chamber 25 of the drum 26. Voltage signals 612 may, for example, be received from sensors 402, 522 and system 500 as discussed above. Further, signals 612 may be received during rotation of the drum 26.

Figure 9:
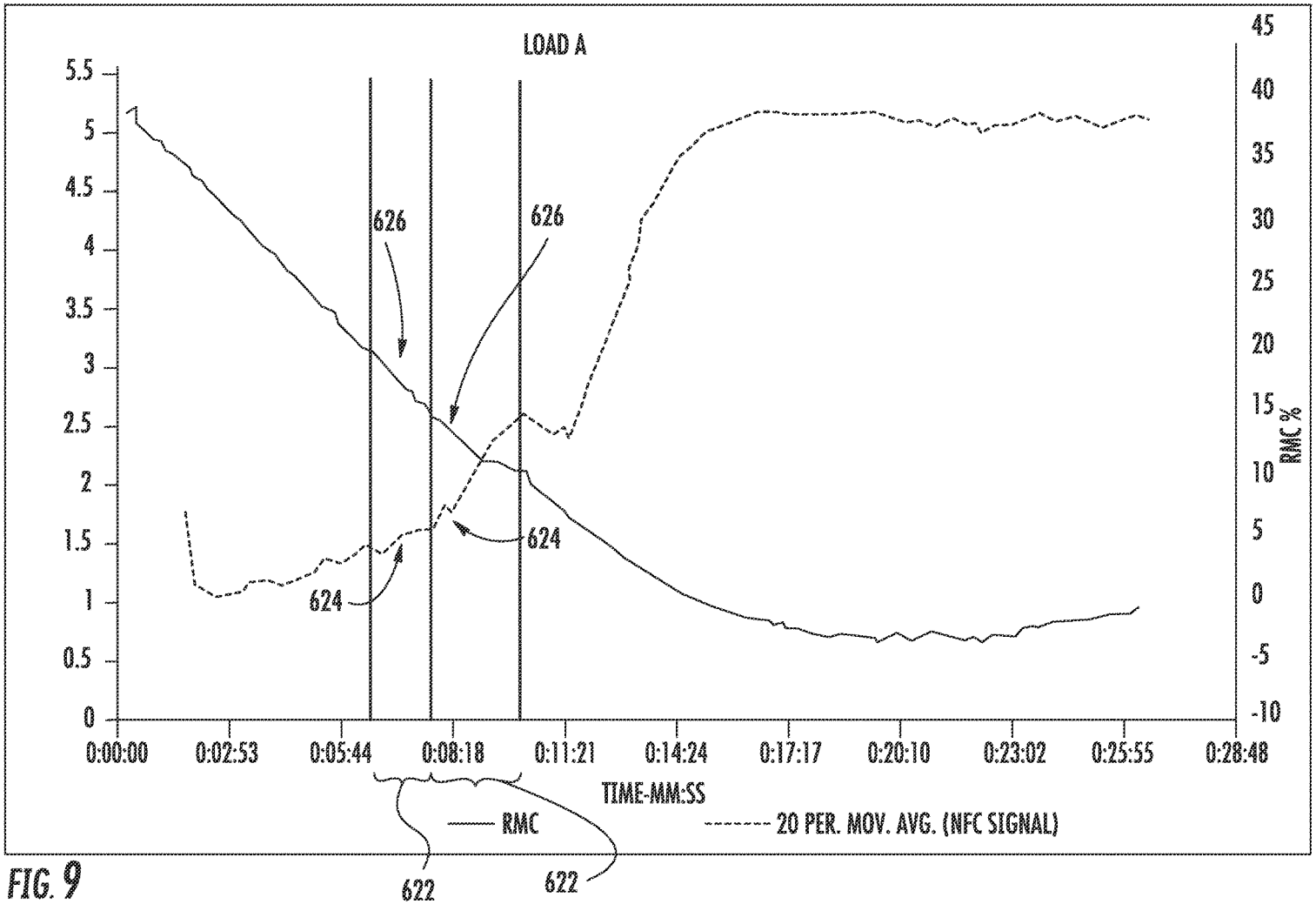
FIG. 9 is a graph illustrating correlation of various variables during operation of a dryer appliance having a particular load of articles therein.
Figure 10:
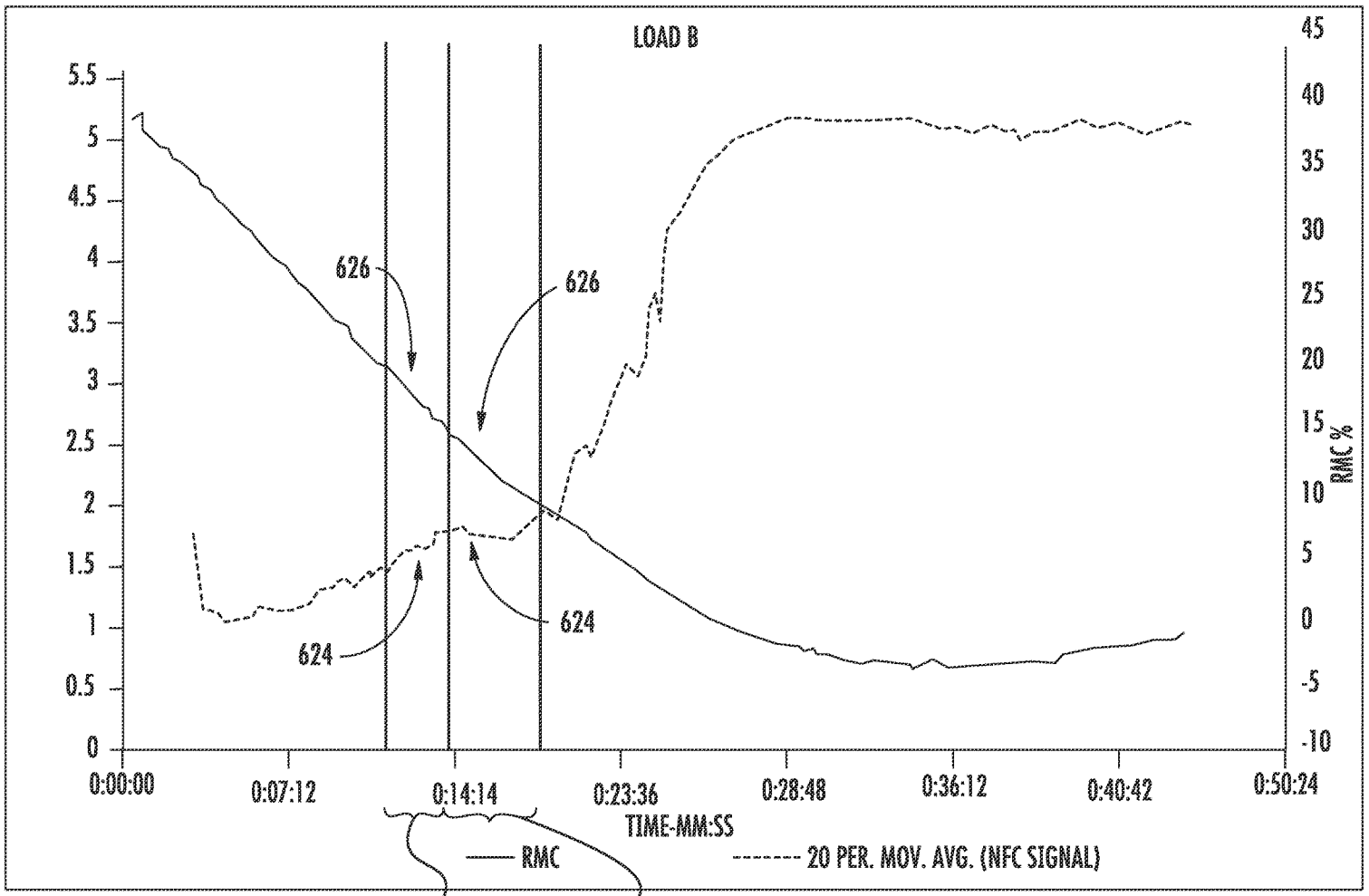
FIG. 10 is a graph illustrating correlation of various variables during operation of a dryer appliance having another particular load of articles therein.
Figure 11:
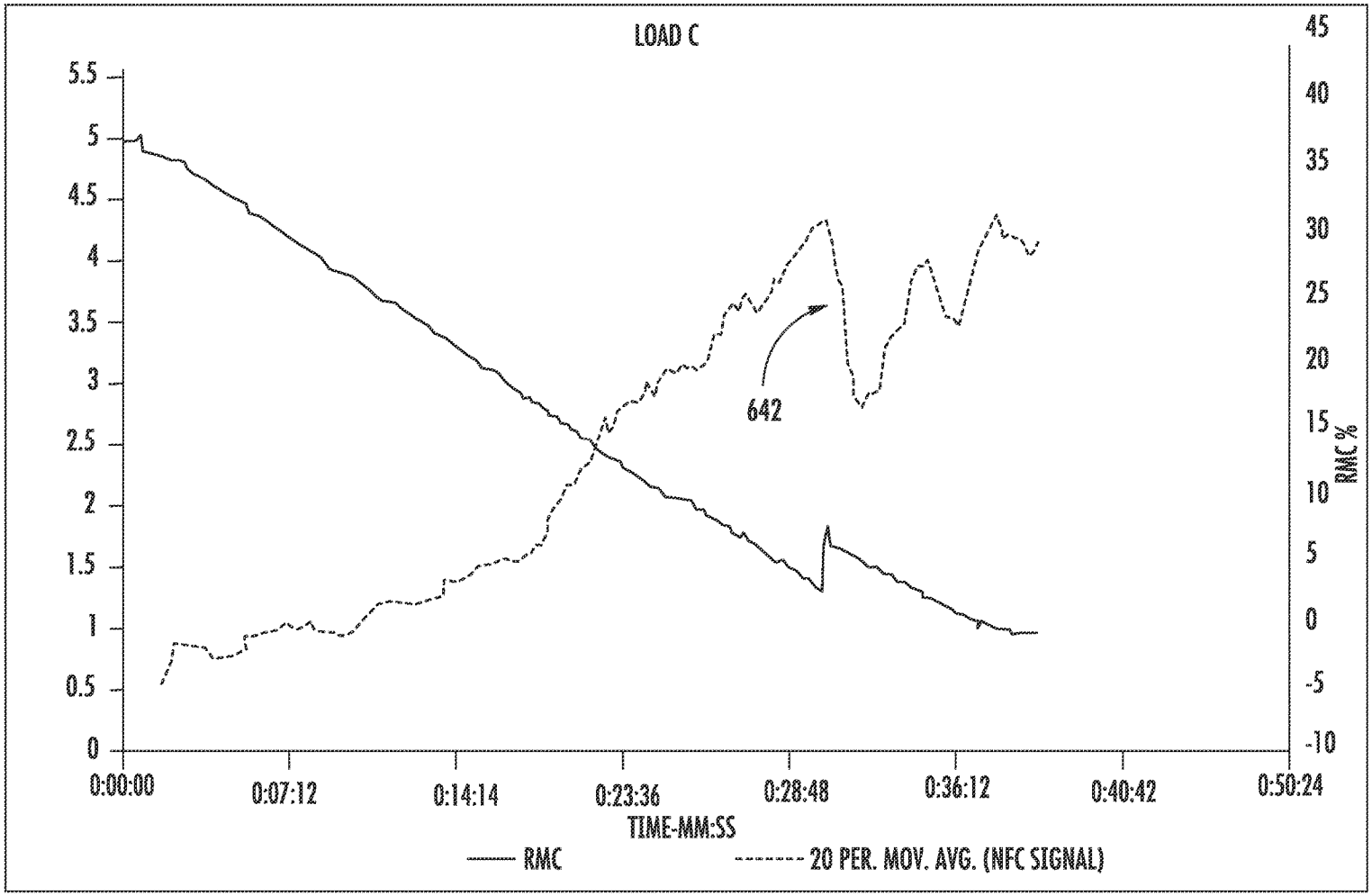
FIG. 11 is a graph illustrating correlation of various variables during operation of a dryer appliance having another particular load of articles therein.

Method 600 may further include, for example, the step 620 of determining whether a voltage signal 612 corresponds to a predetermined drying profile of a plurality of predetermined drying profiles. The predetermined drying profiles may, for example, be stored in the main controller. Each drying profile may include one or more variables or ranges of variables which correlate with each other for a particular load of articles. For example, and referring to FIGS. 9 through 11, each drying profile may include a plurality of drying time ranges 622, a plurality of voltage signal ranges 624, and a plurality of moisture content ranges 626. Each of voltage signal range 624 in a drying profile may correlate to one of the plurality of drying time ranges 622 and one of the plurality of moisture content ranges 626. These profiles can, for example, be empirically determined, such as through test drying of various particular loads of articles. FIGS. 9 through 11 illustrate sample test results. As illustrated, over the course of an overall drying time, voltage signals 602 may generally trend upwards as moisture content trends downwards. These trends can be broken into ranges and correlated through use of broken down drying time ranges 622, as illustrated. Each predetermined drying profile may include the correlated drying time ranges 622, voltage signal ranges 624, and moisture content ranges 626 for a particular load of articles.

The step 620 of determining whether a voltage signal 612 corresponds to a predetermined drying profile thus includes determining which of the plurality of drying profiles the voltage signal 612 matches through comparison of the voltage signal 612 with the various correlated drying time ranges 622, voltage signal ranges 624, and moisture content ranges 626 of each profile. For example, method 600 may further include the step 615 of associating a drying time 617 with each received voltage signal 612. The drying time 617 may, for example, be measured by the main controller (such as by an internal timer of the main controller) and may be an elapsed time of a current drying operation of the appliance 10. The drying time 617 may then be utilized in step 620 with the voltage signal 612. A comparison of the voltage signal 612 and associated drying time 617 with the various correlated drying time ranges 622, voltage signal ranges 624, and moisture content ranges 626 of each profile may be made, and the determination may be made based on which of the various correlated windows of such variable both the voltage signal 612 and associated drying time 617 fit within. Such fit may, for example, within a predetermined error percentage for the voltage signal 612 and/or associated drying time 617, such as plus or minus 2%, 5%, 10%, etc.

Method 600 may further include, for example, the step 630 of applying a drying sequence 632 which corresponds to one of the plurality of predetermined drying profiles when the voltage signal 612 (and, for example, drying time 617) corresponds to that predetermined drying profile. The drying sequence 632 may, for example, include an overall dry time for that profile. For example, in accordance with step 620 an overall dry time for corresponding profile may be applied, such that the overall dry time for the current drying operation is set to that overall dry time (with the remaining dry time for the current drying operation being set to that overall dry time minus the current elapsed dry time).

Method 600 may further include, for example, the step 640 of determining whether the voltage signal 612 corresponds to a wet patch indicator 642. In exemplary embodiments, step 640 only occurs when the voltage signal 612 does not correspond to one of the plurality of predetermined drying profiles as discussed above. Wet patch indicator 642 may, for example, be a level or range of voltage signals that is relatively lower than previously received voltage signals 612 for a currently applied predetermined drying profile. Such downward jump by a voltage signal 612 may indicate that a portion of the articles being dried which is relatively wetter than other portions has, after being unable to contact a sensor for a period of time, now contacted a sensor. FIG. 11 illustrates one embodiment wherein, after a voltage signal trend upwards for a particular predetermined drying profile, the voltage signal 612 then suddenly drops. Notably, such determination may be made based on evaluation of the voltage signal 612 versus a plurality of previously received voltage signals 612 to determine whether the voltage signal 612 is lower than would be expected, and thus for example within a predetermined lower range or less than a predetermined level relative to the trend of the voltage signal for the applied predetermined drying profile. Notably, the level or range for the wet patch indicator 642 may be relative to the trend, and thus may change over time with and relative to voltage signals received during a drying operation.

Method 600 may further include, for example, the step 650 of reversing a direction of rotation of the drum when the voltage signal 612 corresponds to the wet patch indicator 632. Such reversal may, for example, advantageously facilitate increased tumbling of the articles such that relatively more moist portions of the articles are exposed to the sensors and drying of the articles is improved.

Method 600 may further include, for example, the step 660 of determining whether a temperature within the chamber 25 is within a predetermined temperature range 662. In exemplary embodiments, step 660 only occurs when the voltage signal 612 does not correspond to a wet patch indicator 642 as discussed above. In some embodiments, the predetermined temperature range 662 may correspond to the applied predetermined drying profile. Alternatively, the predetermined temperature range 662 may, for example, be a factory setting range for the appliance 10. Method 600 may further include, for example, the step 670 of maintaining the applied drying sequence 632 (which corresponds to the applied predetermined drying profile) when the temperature is within the predetermined temperature range 662. Method 600 may further include, for example, the step 680 of reversing the direction of rotation of the drum when the temperature is outside of the predetermined temperature range 662, such as in some embodiments above the predetermined temperature range 662. Accordingly, overheating and resulting overdrying of the articles may advantageously be reduced or avoided.

In some embodiments, method 600 may include additional initial energy conservation steps. Such steps may, for example, occur before step 610. For example, method 600 may include the step 710 of determining whether the drum is rotating. Such determination may be made through, for example evaluation of sensor 580, evaluation of whether tag 510 and reader 504 have communicated within a predetermined period of time, or evaluation of other suitable components such as proximity sensors or other suitable variable indicative of rotation of the drum.

Method 600 may further include, for example, the step 720 of deactivating one or more components of the wireless moisture data transfer system 500 when the drum is not rotating. The one or more components may include components of the tag 510, such as the controller 516 and/or IC 514, and/or components of the reader, such as IC 506. Method 600 may further include, for example, the step of activating or maintaining activation of the one or more components when the drum is rotating.

Method 600 may further include, for example, the step 730 of determining whether the wireless communication tag 510 is transmitting a voltage signal 612 when the drum is rotating. For example, a determination may be made of whether a transmission from the tag 510 to the receiver 504 has been made within a predetermined time period. Method 600 may further include, for example, the step 740 of deactivating one or more components of the system 500 when the wireless communication tag 510 is not transmitting a voltage signal 612. The one or more components may include components of the tag 510, such as the controller 516 and/or IC 514, and/or components of the reader, such as IC 506. Method 600 may further include, for example, the step of maintaining activation of the one or more components when the tag 510 is transmitting a voltage signal 612.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a dryer appliance, the method comprising:

receiving during rotation of a drum of the dryer appliance a voltage signal which corresponds to a moisture level within a chamber of the drum;

determining whether the voltage signal corresponds to a predetermined drying profile of a plurality of predetermined drying profiles;

applying a drying sequence which corresponds to one of the plurality of predetermined drying profiles when the voltage signal corresponds to the one of the plurality of predetermined drying profiles;

determining whether the voltage signal corresponds to a wet patch indicator by evaluating the voltage signal versus a plurality of previously received voltage signals;

reversing a direction of rotation of the drum when the voltage signal corresponds to the wet patch indicator;

determining whether a temperature within a chamber of the drum is within a predetermined temperature range when the voltage signal does not correspond to the wet patch indicator; and maintaining an applied drying sequence when the temperature is within the redetermined temperature range.

2. The method of claim 1, further comprising:

reversing the direction of rotation of the drum when the temperature is outside of the predetermined temperature range.

3. The method of claim 1, wherein the step of determining whether the voltage signal corresponds to the wet patch indicator only occurs when the voltage signal does not correspond to one of the plurality of predetermined drying profiles.

4. The method of claim 1, further comprising associating a drying time with the voltage signal.

5. The method of claim 1, wherein each of the plurality of predetermined drying profiles comprises a plurality of drying time ranges, voltage signal ranges, and moisture content ranges, each of the plurality of voltage signal ranges correlated to one of the plurality of drying time ranges and one of the plurality of moisture content ranges.

6. The method of claim 1, further comprising:

determining whether the drum is rotating; and deactivating one or more components of a wireless moisture data transfer system when the drum is not rotating, the wireless moisture data transfer system comprising a wireless communication tag and a wireless communication reader.

7. The method of claim 6, further comprising:

determining whether the wireless communication tag is transmitting a voltage signal when the drum is rotating; and deactivating one or more components of the wireless moisture data transfer system when the wireless communication tag is not transmitting a voltage signal.

8. The method of claim 6, wherein the one or more components comprises a component of the wireless communication tag.

9. The method of claim 6, wherein the one or more components comprises a component of the wireless communication reader.

10. The method of claim 6, wherein the wireless communication tag is a near field communication tag and the wireless communication reader is a near field communication reader.

11. A dryer appliance, the dryer appliance comprising:

a cabinet;

a drum rotatably mounted within the cabinet, the drum defining a chamber configured for the receipt of articles for drying;

one or more sensors positioned within the chamber, wherein the one or more sensors output one or more voltage signals which correspond to moisture levels within the chamber;

a near field communication tag positioned on an exterior surface of the drum and in communication with the one or more sensors to receive the voltage signals from the one or more sensors;

a near field communication reader positioned exterior to the drum and configured to receive the voltage signals from the near field communication tag through near field communication; and a main controller in operable communication with the near field communication reader, the main controller configured for:

receiving during rotation of the drum of the dryer appliance a voltage signal which corresponds to a moisture level within the chamber of the drum;

determining whether the voltage signal corresponds to a predetermined drying profile of a plurality of predetermined drying profiles;

applying a drying sequence which corresponds to one of the plurality of predetermined drying profiles when the voltage signal corresponds to the one of the plurality of predetermined drying profiles;

determining whether the voltage signal corresponds to a wet patch indicator by evaluating the voltage signal versus a plurality of previously received voltage signals;

reversing a direction of rotation of the drum when the voltage signal corresponds to the wet patch indicator;

determining whether a temperature within the chamber of the drum is within a predetermined temperature range;

maintaining an applied drying sequence when the temperature is within the redetermined temperature range; and reversing the direction of rotation of the drum when the temperature is outside of the predetermined temperature range.

12. The dryer appliance of claim 11, wherein the main controller is further configured for associating a drying time with the voltage signal.

13. The dryer appliance of claim 11, wherein each of the plurality of predetermined drying profiles comprises a plurality of drying time ranges, voltage signal ranges, and moisture content ranges, each of the plurality of voltage signal ranges correlated to one of the plurality of drying time ranges and one of the plurality of moisture content ranges.

14. The dryer appliance of claim 11, wherein the main controller is further configured for:

determining whether the drum is rotating; and deactivating one or more components of a wireless moisture data transfer system when the drum is not rotating, the wireless moisture data transfer system comprising the near field communication tag and the near field communication reader.

15. The dryer appliance of claim 11, further comprising an integrated circuit for converting the voltage signals from analog data to digital data, and wherein a first portion of the integrated circuit is provided in the near field communication tag and a second portion of the integrated circuit is provided in the near field communication reader.

16. The dryer appliance of claim 11, further comprising an integrated circuit for converting the voltage signals from analog data to digital data, and wherein the integrated circuit is provided in the near field communication reader.

* * * * *